US008875688B2

(12) United States Patent
Nugent

(10) Patent No.: US 8,875,688 B2
(45) Date of Patent: Nov. 4, 2014

(54) SAFETY VALVE FOR TOY AIR GUNS

(75) Inventor: David Michael Nugent, Newport, RI (US)

(73) Assignee: Hasbro, Inc., Pawtucket, RI (US)

( * ) Notice: Subject to any disclaimer, the term of this patent is extended or adjusted under 35 U.S.C. 154(b) by 127 days.

(21) Appl. No.: 13/420,875

(22) Filed: Mar. 15, 2012

(65) Prior Publication Data

US 2013/0239939 A1 Sep. 19, 2013

(51) Int. Cl.
*F41B 11/00* (2013.01)
*F41B 11/642* (2013.01)
*F41B 11/723* (2013.01)

(52) U.S. Cl.
CPC ..... *F41B 11/642* (2013.01); *F41B 11/723* (2013.01)
USPC ..... 124/73; 124/76; 124/66

(58) Field of Classification Search
CPC ..... F41B 11/723; F41B 11/642
USPC ..... 124/63–66, 69–73, 76
See application file for complete search history.

(56) References Cited

U.S. PATENT DOCUMENTS

| | | | | |
|---|---|---|---|---|
| 961,511 | A | 6/1910 | Marble | |
| 1,374,757 | A | 4/1921 | Napier | |
| 1,441,975 | A | 1/1923 | Edelin | |
| 2,109,589 | A | 3/1938 | Horwitt et al. | |
| 3,968,783 | A | 7/1976 | Pfotenhauer | |
| 4,170,215 | A | 10/1979 | Kettlestrings | |
| 4,248,202 | A | 2/1981 | Jaworski et al. | |
| 4,659,320 | A | 4/1987 | Rich et al. | |
| 5,267,549 | A | 12/1993 | Webber | |
| 5,292,134 | A | 3/1994 | Schlundt et al. | |
| 5,343,850 | A | 9/1994 | Steer | |
| 5,373,833 | A | 12/1994 | D'Andrade | |
| 5,377,656 | A | 1/1995 | Lewinski et al. | |
| 5,433,646 | A | 7/1995 | Tarng | |
| 5,471,967 | A | 12/1995 | Matsuzaki et al. | |
| 5,476,087 | A | 12/1995 | Kunimoto | |
| 5,515,837 | A | 5/1996 | Nin et al. | |
| 5,529,050 | A | 6/1996 | D'Andrade | |
| 5,535,729 | A | 7/1996 | Griffin et al. | |
| 5,605,140 | A | 2/1997 | Griffin | |
| 5,611,322 | A | 3/1997 | Matsuzaki et al. | |
| 5,711,285 | A | 1/1998 | Stewart et al. | |
| 5,996,564 | A | 12/1999 | Kotowski | |
| 6,224,457 | B1 | 5/2001 | Wu | |
| 6,279,562 | B1 | 8/2001 | Clayton | |
| 6,598,329 | B1 | 7/2003 | Alexander | |
| 6,733,356 | B2 | 5/2004 | Lee | |
| 7,287,526 | B1 | 10/2007 | Bligh et al. | |
| 7,387,117 | B2 * | 6/2008 | Kunimoto | 124/73 |
| 7,418,797 | B1 | 9/2008 | Crose | |

(Continued)

*Primary Examiner* — Stephen M Johnson
*Assistant Examiner* — Benjamin Gomberg
(74) *Attorney, Agent, or Firm* — Perry Hoffman

(57) ABSTRACT

An improved safety valve for a toy air gun apparatus in which the toy air gun includes a piston and a drive spring mounted in a grip portion of the air gun. A handle extends from the bottom of the grip portion and is manipulated by the user to cock the air gun by compressing the drive spring. When the user pull a trigger the piston is released and surges upward because of the expanding drive spring. A valve element located to the rear of a barrel section of the air gun receives a blast of compressed air in a direction lateral to the longitudinal axis of the valve element and lateral to valve element movement between an open, rearward position and a closed, forward position.

19 Claims, 3 Drawing Sheets

(56) References Cited

U.S. PATENT DOCUMENTS

| | | | |
|---|---|---|---|
| 7,437,847 | B1 | 10/2008 | Mabry |
| 7,481,209 | B1 | 1/2009 | Bligh et al. |
| 7,552,557 | B1 | 6/2009 | Mabry |
| 7,673,624 | B2 | 3/2010 | Rosella, Jr. |
| 2006/0242880 | A1 | 11/2006 | Griffin |
| 2011/0146645 | A1 | 6/2011 | Ma |

* cited by examiner

SAFETY VALVE FOR TOY AIR GUNS

FIELD OF THE INVENTION

The present invention relates generally to an improved safety valve for toy air guns, and, more particularly, to an improved safety valve that makes more efficient use of compressed air generated by the toy guns.

BACKGROUND OF THE INVENTION

Toys and other devices that discharge projectiles by release of a compressed or stretched spring or other means to compress air are well known and are disclosed in earlier patents. Safety valves are also known. By way of example, U.S. Pat. No. 1,441,975, for a "Pneumatic Toy Pistol" issued in 1923 to Edelin purports to disclose an air gun where compressed air is created by a piston being driven in a cylinder by an expanding compressed spring, and includes a valve and a BB-like projectile in a barrel. The valve includes a first stationary tube having an opening, the first tube being located at the top end of the cylinder, and a second tube slidable in the first tube and also having an opening. The opening in the second tube is misaligned with the opening in the first tube when the valve is closed and the two openings are aligned when the valve is open. Alignment of the openings is accomplished when a nut located at the top of the piston engages a spring biased pin attached to the second tube. Typically, the valve is biased closed. Engagement occurs when the piston reaches the end of its upward movement in the cylinder such that the open valve allows a blast of compressed air from the cylinder to exit through the valve, impinge on the projectile and cause its discharge.

U.S. Pat. No. 5,343,850 for a "Double Shot Projectile Launcher" issued in 1994 to Steer purports to disclose a double barrel launcher using a bellows for generating a blast of compressed air. The path of the compressed air is determined by manipulation of a trigger that operates a slide valve. The slide valve aligns openings to clear an air path to one of two projectile supporting launch tubes. The air path is blocked when the slide valve misaligns the openings to the launch tube.

A safety valve appears in a patent issued to Nin and D'Andrade, U.S. Pat. No. 5,515,837, granted in 1996, and entitled "Safety Nozzle For Multi-Shot Projectile Shooting Air Gun," and in U.S. Pat. No. 5,529,050, also issued in 1996 to D'Andrade entitled "Safety Nozzle For Projectile Shooting Air Gun." The '837 and '050 patents purport to describe a toy air gun safety valve for firing soft foam darts where the valve does not open unless the dart inserted into a launch tube has a predetermined shape that matches a configuration of the valve to enable the dart to push the valve to an open position. The '837 patent also discloses a revolving launch tube magazine, a series of spring biased pins on the magazine with one pin besides each of the launch tubes, a second valve in the form of a hinged flap, and a trigger. Pulling the trigger discharges a dart and rotates the magazine to align another tube of the magazine in front of a pressurized air tank. When the magazine revolves, a spring biased pin on the magazine next to the tube extends outward to swing the hinged flap from a closed position to an open position whether or not the launch tube is loaded. Compressed air generated by the air gun passes through the second valve and then through the safety valve in an axial direction.

Two more recent patents to Bligh, Mead and Brown, U.S. Pat. No. 7,287,526 and U.S. Pat. No. 7,481,209, both entitled "Toy Projectile Launcher With Slidable Outer Cylinder and Stationary Inner Compression Member," the later patent being a divisional of the earlier patent, purport to disclose a safety valve for an air gun. Moving a slide generates a blast of compressed air and, once actuated, the air flows to the valve in an axial direction. A recently published U.S. Application, No. 2011/0146645, for a "Toy Air Gun" listing Chor-Ming Ma as inventor, purports to disclose a fixed multiple barrel device with a piston and cylinder arrangement. A pressure chamber is located at the front end of the piston and cylinder arrangement, and a rotatable disc is located in the pressure chamber with a single port that is indexed with each discharge to move to the next barrel. Compressed air created by the piston enters the pressure chamber and exits axially through the single port.

These patents and application and the devices disclosed are of some interest, however, they do not teach an efficient safety valve.

SUMMARY OF THE INVENTION

In accordance with the present invention, an advantageous method and system are described in the form of an improved safety valve for air guns that allows a blast of compressed air to enter the valve from the side, laterally or radially instead of axially as is the case with existing safety valves. The improved safety valve is more efficient, simply constructed, structurally robust, compact, easily operated and relatively inexpensive.

Briefly summarized, the invention relates to an improved safety valve for toy air guns including a housing having a valve chamber and an air inlet port, the housing for mounting a source of compressed air, and a valve element mounted in the chamber of the housing, the valve element having a front section, a rear section and a wall separating the front and rear sections, the front section having structure for engaging a projectile inserted in a launch site of the toy air gun, the valve element being movable in the valve chamber by the projectile in a direction parallel to the longitudinal axis of the valve element from a closed, forward position to an open, rearward position, the rear section for cooperating with a spring, the spring for biasing the valve element from the rearward position to the forward position, and wherein when in the rearward position the valve element communicates the source of compressed air through the air inlet port with a projectile in the associated launch site, and a blast of compressed air from the compressed air source is received by the valve element from the air inlet port in a direction lateral to the longitudinal axis of the valve element, the blast of compressed air flowing through the front section structure forward of the separating wall.

The invention also relates to a method for making a toy air gun with an improved safety valve including the steps of forming a housing with a barrel section for receiving a projectile, a grip section, and a structure forming a chamber and a front valve seat, mounting a piston and a drive spring in the grip section of the housing, mounting a handle to the piston and a trigger to the housing, forming an air inlet port between the grip section and the chamber, forming a valve element having a longitudinal axis, a front section having a configuration for engagement of a projectile inserted in the barrel section and for enabling the passage of a blast of compressed air from a direction lateral to the longitudinal axis of the valve element, a rear section seating one end of a biasing spring, and a wall separating the front and rear sections, mounting the valve element in the chamber of the housing adjacent to the air inlet port to move between forward and rearward positions and to receive a blast of compressed air in a direction lateral to the longitudinal axis of the valve element, and mounting a biasing spring between the housing and the separating wall of the valve element.

BRIEF DESCRIPTION OF THE DRAWINGS

For the purpose of facilitating an understanding of the invention, the accompanying drawings and detailed description illustrate embodiments thereof, from which the structures, construction and operation, processes, and many related advantages of the embodiments may be readily understood and appreciated.

DESCRIPTION OF THE EMBODIMENTS

Figure 1:
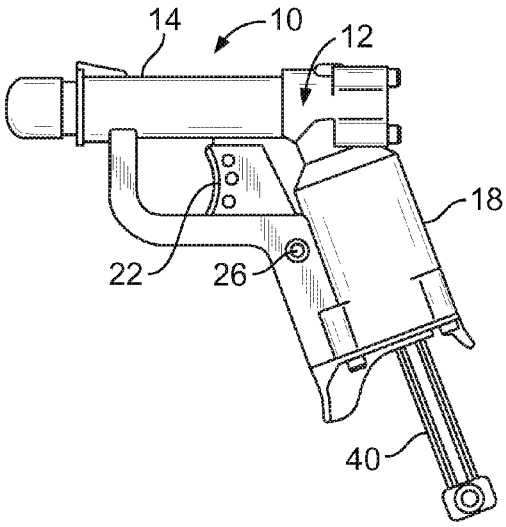
FIG. 1 is a diagrammatic side elevation view of a toy gun apparatus having the improved safety valve of the present invention, the gun apparatus being loaded with a projectile and illustrated in a cocked configuration.
Figure 2:
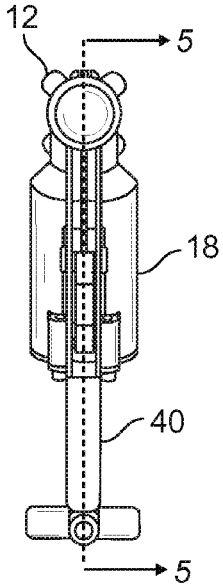
FIG. 2 is a diagrammatic front elevation view of the toy gun apparatus illustrated in FIG. 1.

The following description is provided to enable those skilled in the art to make and use the described embodiments set forth. Various modifications, equivalents, variations, and alternatives, however, will remain readily apparent to those skilled in the art. Any and all such modifications, variations, equivalents, and alternatives are intended to fall within the spirit and scope of the present invention defined by the below listed claims.

Air guns are well known as shown by the above-mentioned earlier patents and published application. Also well known are safety valves, such as the safety valve described in U.S. Pat. No. 5,515,837, mentioned above. The safety valve disclosed in the '837 patent includes a movable valve element with protrusions and a center pad that plug openings in a fixed wall, the openings in the wall and the valve element defining an air path to a projectile to be discharged. The air path begins at a cylinder port located where the piston ends its travel in the cylinder. The air path continues to the safety valve so as to approach the safety valve from an axial direction that is parallel to the direction of valve element movement between open and closed positions. The valve element includes a configuration that will not unblock the wall openings until a projectile with a predetermined shape for engaging the specially designed valve element is inserted into a projectile tube or barrel to push the valve element away from the wall.

The projectile and valve element arrangement is a safety measure to prevent undesirable objects from being loaded and discharged by the air gun. The projectile with the matching shape to the valve element pushes the valve element against a biasing spring and places the projectile near the fixed wall and its openings and in operative communication with the cylinder, piston and spring combination which is the compressed air source. After the trigger of the air gun is activated, a blast of compressed air from the source flows to the safety valve and to the projectile and moves them both. It is noted that with the axial movement of the compressed air against and around the valve element and through the wall openings, energy is dissipated and a relatively large pressure drop results even before the blast of compressed air reaches the projectile to cause discharge. Therefore, the arrangement is inefficient, and a major advantage of the present invention is that this inefficiency is obviated.

Referring now to FIGS. 1, 2, 5 and 6, a toy air gun 10 is illustrated and includes a housing 12, formed into a barrel section 14, a valve chamber 16 rearward of the barrel portion, and a grip section 18. Mounted in the valve chamber 16 is a valve element 20, and below the barrel portion 14 is a trigger 22 integral with a downward extending arm 24 pivoted to the housing 12 with a pin 26. The grip section 18 of the housing forms a cylinder 30 and mounted in the cylinder are a piston 32 and a drive spring 34. The drive spring 34 is mounted between the piston 32 and a bottom 36 of the grip section. An elongated handle 40 extends from the bottom 36 of the grip portion 18 to allow operation by a user to cock the air gun, and the upper portion of the handle is connected to the piston 32. The cylinder 30 narrows above the piston 32 to an air inlet port 42 just below the position of the valve element 20. A cap plate 50 including a central spike or post 52 is fastened to the rear of the housing 12 and acts as a spring seat for one end of a valve element biasing spring 54. The other end of the biasing spring 54 is seated against the valve element 20.

Figure 5:
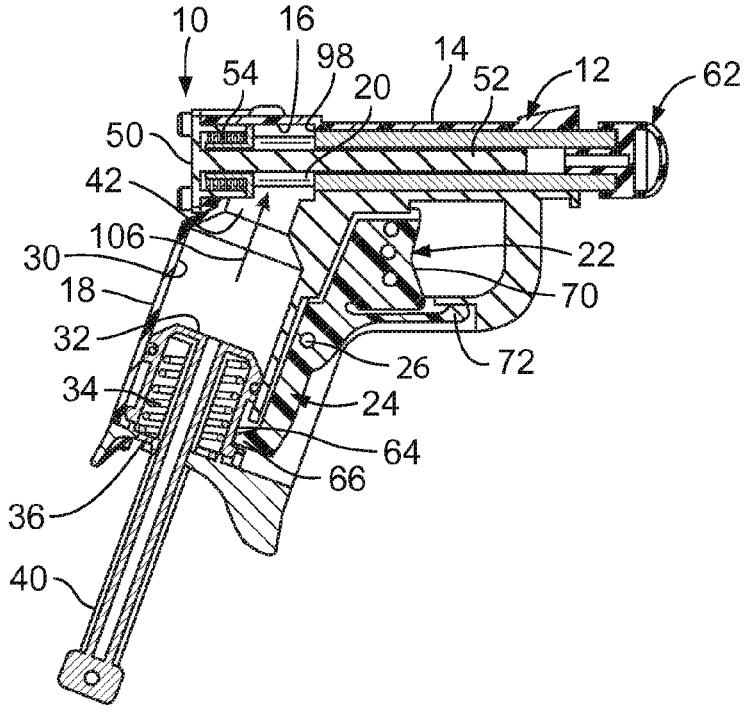
FIG. 5 is a diagrammatic section view taken along line 5-5 of FIG. 2, illustrating the air gun in a loaded and cocked configuration and where the valve element is in an open, rearward position.

The barrel section 14, or more broadly the launch site section, is shown loaded with a projectile, such as a dart 62 made of NERF™ brand foam, a solid, spongy cellular material. Loading or inserting the dart 62 into the barrel section 14 causes the valve element 20 to be pushed from a closed, forward position, shown in FIG. 6, to an open, rearward position, shown in FIG. 5. Cocking the air gun by pulling down on the handle 40 brings the piston 32 to a lowered position causing the drive spring 34 to be compressed as illustrated in FIG. 5. The piston 32 includes a notch 64 and the piston is held in place by a lower tab 66 of the trigger arm 24, which engages the notch. The trigger 22 has an upper pull surface 70 for the user's finger in the usual fashion and a forward extending flexible arm 72 for biasing the trigger to the forward position and the tab to a rearward position, also as illustrated in FIG. 5. Illustrated in FIG. 6, the dart 62 is shown being discharged, the piston 32 is in an upward location, the drive spring 34 is in an expanded condition, the trigger 22 in a rearward position as it would be when pulled by the user, the lower tab 66 has pivoted counterclockwise away from the notch 64 allowing the piston to be released, and the valve element 20 has moved to the closed, forward position from the open, rearward position because of the biasing spring 54 and the absence of the dart in the barrel section.

Figure 3:
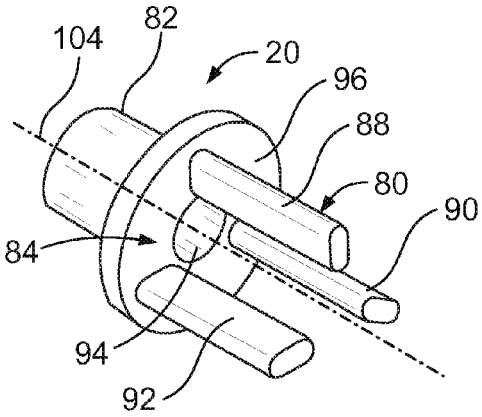
FIG. 3 is an enlarged diagrammatic isometric view of a valve element of the improved safety valve.

The valve element 20, enlarged, is illustrated in FIG. 3, and includes a front section 80, a rear section 82 and a separating wall 84. The valve element front section 80 includes a specific configuration, such as three short, spaced apart, posts 88, 90, 92. The separating wall 84 includes an opening 94 for receiving the spike 52, FIG. 5. The separating wall 84 also includes a front surface 96, FIG. 3, to engage a front valve seat 98, identified in FIG. 5, at a forward end of the structure surrounding the valve chamber 16 when the valve element 20 is in the closed, forward position, the closed position being illustrated in FIG. 6. The open position of the valve element is illustrated in FIG. 5. The rear section 82 of the valve element may have a tubular configuration and be used for supporting the valve element biasing spring 54.

Figure 6:
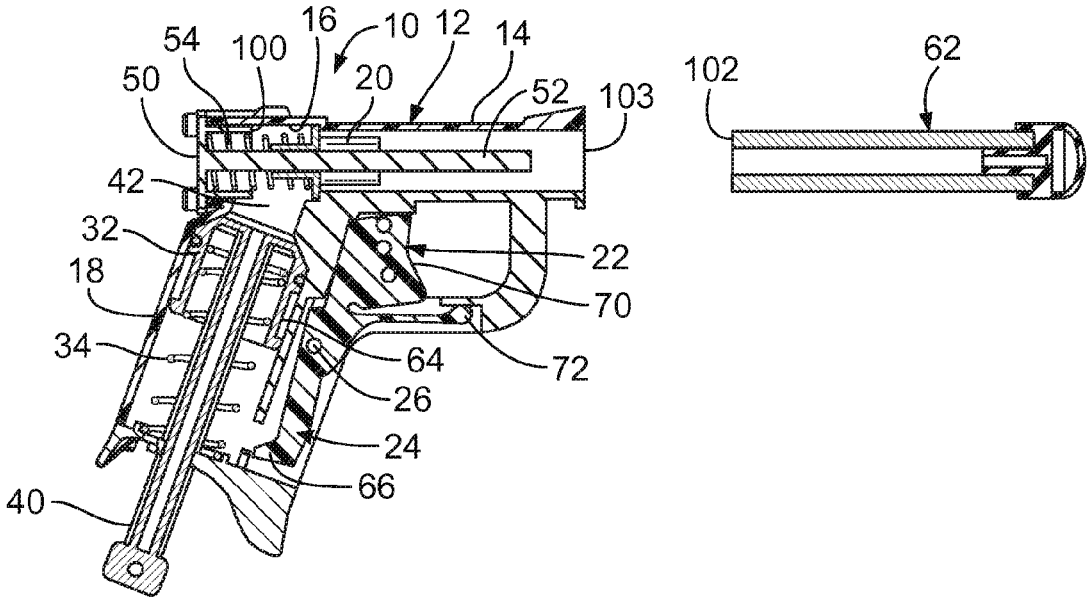
FIG. 6 is a diagrammatic section view similar to that shown in FIG. 5, but illustrating the air gun discharging a projectile with the air gun no longer cocked and the valve element in a closed, forward position.

The dart 62 has a tubular configuration including a ring shaped rear wall 102, FIG. 6, such that when inserted or loaded into a front opening 103, FIG. 6, of the barrel portion 14, the tubular dart is slipped over the spike 52, and then guided rearward so that the rear wall 102 of the dart engages with and pushes on the three posts 88, 90, 92 to cause the valve element 20 to move rearward. Thus, the dart 62 causes the valve element 20 to move from the closed forward position shown in FIG. 6, to the open, rearward position shown in FIG. 5. Friction between the outer surface of the dart and the inner surface of the barrel portion prevents the dart from falling out of the barrel section and maintains the biasing spring 54 in a compressed condition. Once the dart 62 is discharged, the biasing spring 54 causes the valve element 20 to move from the rearward position to the forward position.

When the valve element is in the open, rearward position, air is able to enter laterally relative to a longitudinal axis 104, FIG. 3, of the valve element and move easily around the posts 88, 90, 92 because of their spaced apart locations. Passing compressed air is subject to little interference and, therefore, experiences a very low pressure-drop. Moreover, the blast of compressed air does not expend energy closing the valve element as was the case with prior safety valves. Rather, the main function of the blast of compressed air is to push the dart out of the barrel section. An arrow 106, FIG. 5, symbolizes the lateral introduction of airflow through the valve element 20 when the valve element is in the rearward position.

Figure 4:
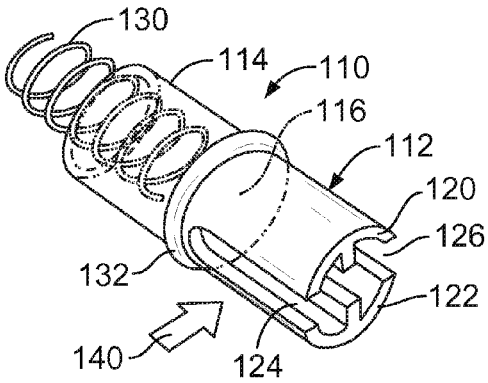
FIG. 4 is a diagrammatic isometric view of another valve element embodiment.

In the alternative, the valve element may assume another configuration. Illustrated in FIG. 4, is a valve element 110 having a front section 112, a rear section 114 and a wall 116 between the front and rear sections. The valve element front section 112 includes a specific configuration for engaging a dart, such as two arcuate arms 120, 122, spaced apart by two slots 124, 126. The rear section 114 may be tubular for receiving one end portion of a valve element biasing spring 130. An O-ring 132 is positioned around the exterior of the valve element 110. With the structure shown, a spike plate (not shown) having a spike may be located forward of the valve element. Such a spike plate may include two arcuate openings for allowing the arcuate arms 120, 122 to move forward and rearward and for a blast of compressed air to pass. The valve element 110 moves rearward in response to an inserted dart and forward in response to the biasing spring 130. Because the spike would be forward of the valve element, no opening in the separating wall 116 is required. The ring shaped rear wall 102 of the tubular dart 62, when loaded into the barrel section, engages and pushes on the arcuate arms 120, 122 to move the valve element 110 rearward. As with the embodiment shown in FIG. 3, the dart causes the valve element to move from a closed, forward position to an open, rearward position. After discharge of the dart, the biasing spring 130 causes the valve element to move from the rearward position to the forward position. A blast of compressed air enters the valve element 110 laterally through the slot 124 as symbolized by an arrow 140.

Also in the alternative, another embodiment may be use in a multiple barrel air gun as disclosed in detail in a co-pending application entitled "Air Path And Safety Valve System For Toy Launchers," application Ser. No. 13/420,855 on Mar. 15, 2012, where the embodiment which is similar to that shown in FIG. 4, has a side opening in the rear section to allow a blast of compressed air to bypass the valve element (by flowing through the rear section of the valve element when it is in a forward closed position) and proceed to the next valve element in an open rearward position which indicates an inserted dart in an associated barrel.

The upper section of the grip portion 18, FIG. 5, narrows to form the inlet port 42 to direct a blast of compressed air to the valve element 20 and the chamber 16 in which the valve element moves. The structure around the chamber includes the forward valve seat 98. When the valve element is in the rearward position a blast of compressed air will be directed by the inlet port to the valve element in a direction lateral to the longitudinal axis 104 of the valve element that is parallel to the direction of movement of the valve element. When air is directed laterally to the valve element, the air passes the through the spaced apart posts of the valve element 20 shown in FIG. 3, as the blast of compressed air flows to the dart, or through the slot 124 between the arcuate arms of the valve element 110 shown in FIG. 4, before flowing to the dart. In either situation, the airflow meets little resistance, or stated another way, suffers a small pressure drop. A major advantage of the present invention is that the air gun uses generated compressed air in a more efficient manner than previous air guns. The air gun housing, the valve elements, and the cylinder and piston may all be made of a suitable plastic or plastics, as are well known to those of skill in the art.

In operation, the user inserts the dart 62 into the barrel section 14 causing the valve element 20 to be pushed rearward to the open position and compress the biasing spring 54, as shown in FIG. 5. Friction between the outer surface of the dart and the inner surface of the barrel section is sufficient to maintain the dart in position and the valve element in the rearward position. The user may cock the air gun by pulling the handle 40 downward. Downward movement of the handle lowers the piston 32 and compresses the drive spring 34. The spring arm 72 of the trigger 22 biases the tab 66 into the notch 64 of the piston and retains the piston in the cocked position until released by the user.

Discharging the dart occurs by the user pulling the trigger rearward to pivot the tab from the notch so as to allow the compressed drive spring to expand and rapidly move the piston upwards. A blast of compressed air is created ahead of the surging piston 32 and enters the inlet port 42 and passes through the front section of the valve element in a direction lateral to the longitudinal axis 104 of the valve element and lateral to its direction of movement. The blast of compressed air moves forward to the loaded dart and causes the dart's discharge as shown in FIG. 6. Inertia of the valve element delays its closing. Porting the air blast in the front section of the valve element reduces the tendency of the blast of compressed air to slam the valve element shut before the dart has left the barrel section.

After the valve element is moved to the forward position, the wall 84 of the valve element abuts the forward valve seat 98. Thereafter, should the user again cock the air gun and activate the trigger, but not insert a dart, the next blast of compressed air is released slowly with insufficient pressure to impact significant velocity to any improvised projectile not having a proper configuration, another safety feature of the present invention. In the alternative, a rear valve seat may be formed in the structure around the chamber 16.

Other types of projectiles besides foam darts may be used, such as BBs, balls or pellets, with appropriate modification to the internal mechanisms of the gun apparatus. The toy air gun may also be reconfigured as a launch site apparatus for foam discs, foam washers or resilient bands. Thus, the barrel section may be reconfigured and more properly termed a launch site section. It will be understood by those with skill in the art that the design of the launch site section is a function of the projectile being used. Also in the alternative, the gun apparatus may be made of metal or a combination of metal and plastic.

It is noted that throughout this description, words such as "forward", "rearward", "upward", "downward", "upper", and "lower", as well as like terms, refer to portions or elements of the gun apparatus as they are viewed in the drawings relative to other portions or in relationship to the positions of the apparatus as it will typically be held and moved during play when operated by a user, or to movements of elements based on the configurations illustrated.

The toy air gun apparatus may include, in the alternative, a projectile magazine, a cartridge, a cassette or a canister loaded with multiple projectiles to load the projectiles, sequentially, into a firing or discharge position. The air gun apparatus disclosed in detail above provides for easy cocking in a simple, efficient and safe manner, and yet the air gun has a robust, but relatively simple structure that may be produced at a reasonable cost.

Figure 7:
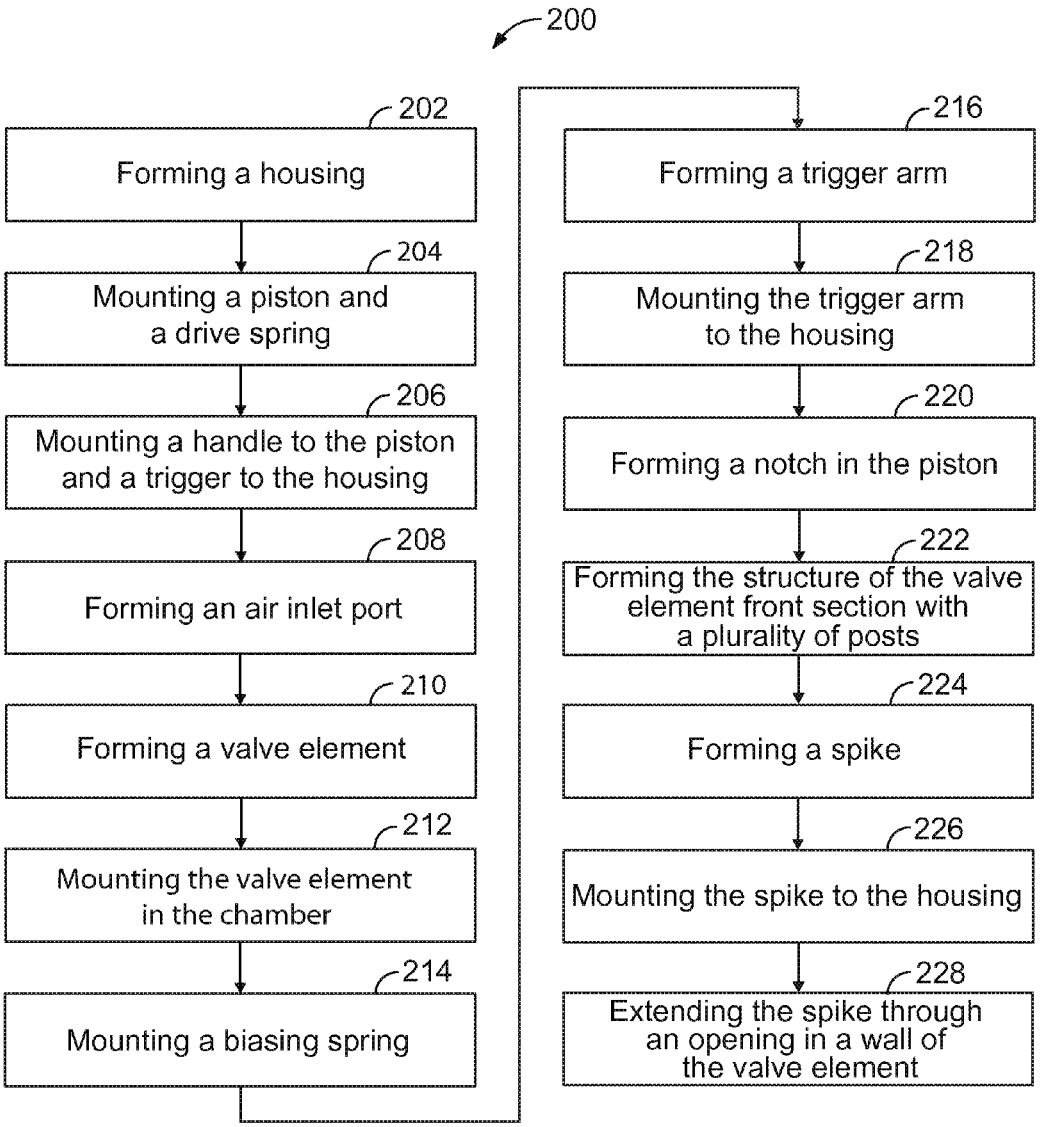
FIG. 7 is a flow diagram for a method of making an air gun with the improved safety valve.

The present invention also includes a method 200, FIG. 7, for making the air gun with an improved safety valve, including the steps of forming a housing 202 with a barrel section for receiving a projectile, a grip section, and a structure forming a chamber and a front valve seat, mounting a piston and a drive spring 204 in the grip section of the housing, mounting a handle to the piston and a trigger to the housing 206, forming an air inlet port 208 between the grip section and the chamber, forming a valve element 210 having a longitudinal axis, a front section having a configuration for engagement of a projectile inserted in the barrel section and for enabling the passage of a blast of compressed air from a direction lateral to the longitudinal axis of the valve element, a rear section seating one end of a biasing spring, and a wall separating the front and rear sections, mounting the valve element in the chamber 212 of the housing adjacent to the air inlet port to move between forward and rearward positions and to receive a blast of compressed air in a direction lateral to the longitudinal axis of the valve element, and mounting a biasing spring 214 between the housing and the separating wall of the valve element. The method for making the air gun may also include forming a trigger 216 having a downward extending arm with an end tab and a forward extending spring arm, mounting the trigger to the housing 218, forming a notch in the piston 220 for receiving the end tab of the trigger when the piston is lowered in the grip section, forming the structure of the valve element front section with a plurality of posts 222 for engaging a ring shaped rear wall of the projectile when the projectile is inserted in the barrel section, forming a spike 224, mounting the spike to the housing 226, and extending the spike through an opening in the separating wall 228 of the valve element.

From the foregoing, it can be seen that there has been provided structure and features for an improved safety valve for a toy air gun apparatus and a disclosure for the method of the making the toy air gun apparatus. While particular embodiments of the improved safety valve have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An improved safety valve for toy air guns comprising:

a housing having a valve chamber fixed within the housing, a barrel section, and a fixed air inlet port, the housing for mounting a source of compressed air; and a valve element mounted in the valve chamber of the housing, the valve element having a front section, a rear section and a wall separating the front and rear sections, the front section having structure for being engaged by a projectile inserted from a front opening of the barrel section, the valve element being movable in the valve chamber by a rear wall of the projectile in a direction parallel to a longitudinal axis of the valve element from a closed, forward position to an open, rearward position entirely within the valve chamber, the rear section for cooperating with a spring, the spring for biasing the valve element from the rearward position to the forward position, and the front section structure being within the valve chamber at the fixed air inlet port when the front section structure of the valve element engages with the rear wall of the inserted projectile, wherein the valve element communicates the source of compressed air through the fixed air inlet port at the front section structure of the valve element to the projectile in a direction lateral to the longitudinal axis of the valve element through the front section structure forward of the separating wall.

2. The improved safety valve of claim 1, wherein:

the biasing spring is mounted between the housing and the separating wall of the valve element.

3. The improved safety valve of claim 1, including:

a spike connected to the housing and extending through an opening in the separating wall.

4. The improved safety valve of claim 1, including:

a front valve seat in the valve chamber for engaging a peripheral portion of the separating wall of the valve element.

5. The improved safety valve of claim 1, wherein:

the structure of the front section for being engaged by the projectile includes a plurality of posts for engaging a ring shaped rear wall of the projectile.

6. The improved safety valve of claim 1, including:

a trigger pivotally mounted to the housing, the trigger having a downward extending arm with an end tab and a forward extending spring arm; and a pin connecting the trigger to the housing.

7. The improved safety valve of claim 6, wherein:

the housing includes a grip section;

the source of compressed air includes a piston moveable in the grip section, a drive spring mounted between the piston and a bottom of the grip section, and a handle extending from the grip section for lowering the piston and compressing the drive spring; and the piston includes a notch for receiving the end tab of the trigger when the piston is lowered.

8. The improved safety valve of claim 7, wherein:

the biasing spring is mounted between the housing and the separating wall; and including a spike connected to the housing and extending through an opening in the separating wall.

9. The improved safety valve of claim 8, wherein:

the chamber of the housing includes a front valve seat for engaging the separating wall of the valve element; and the structure of the front section for being engaged by the projectile includes a plurality of posts for engaging a ring shaped rear wall of the projectile.

10. An improved safety valve for toy air guns comprising:

a housing having a fixed valve chamber, a fixed air inlet port, and a barrel section located forward of the valve chamber for receiving an elongated projectile inserted through a front of the barrel section at the housing and a grip section for mounting a source of compressed air beneath the air inlet port;

a valve element mounted in the valve chamber of the housing, the valve element having a front section, a rear section and a wall separating the front and rear sections, and including a spring for biasing the valve element from a rearward open position to a forward closed position, the front section of the valve element to be engaged by the inserted projectile for causing the valve element to be moved from the closed position to the open position entirely within the valve chamber for causing the biasing spring to be compressed, the front section being a plurality of forward extending and spaced apart structures within the valve chamber at the fixed air inlet port when the front section structure of the valve element engages with the inserted projectile, wherein the valve element communicates the source of compressed air through the fixed air inlet port at the front section structure of the valve element from beneath the air inlet port to the projectile, the rear section for cooperating with the spring to bias the valve element to the closed position in the absence of the elongated projectile; and a front valve seat in the valve chamber of the housing for engaging the separating wall of the valve element when the valve element is in the closed position.

11. The improved safety valve of claim 10, comprising:

a spike connected to the housing in a fixed position, the spike extending from a rear of the valve chamber into the barrel section and through an opening in the separating wall.

12. The improved safety valve of claim 10, wherein:

the front section for engaging the projectile includes a plurality of posts.

13. The improved safety valve of claim 10, comprising:

a trigger pivotally mounted to the housing, the trigger having a downward extending arm.

14. The improved safety valve of claim 13, wherein:

the source of compressed air includes a piston moveable in the grip section, a drive spring mounted between the piston and a bottom of the grip section, and a handle extending from the grip section for lowering the piston and compressing the drive spring; and the piston includes a notch for receiving the arm of the trigger when the piston is cocked.

15. An improved safety valve for toy air guns comprising:

a housing having a barrel section, a fixed valve chamber rearward of the barrel section, a valve seat forward in the valve chamber, a grip section located beneath the valve chamber, and a fixed air inlet port, the grip section for mounting a compressed air source including a piston, a drive spring and a cocking handle and the barrel section including a front opening for receiving an elongated projectile having a rear wall;

a valve element mounted in the valve chamber and movable between forward and rearward positions, the valve element having a front section, a rear section and a separating wall, the front section having a plurality of forward extending and spaced apart structures for engaging the rear wall of the elongated projectile when the valve element is moved by the projectile from the forward position to the rearward position entirely within the valve chamber, the front section being located above the air inlet port when the valve element is in the rearward position to enable compressed air to flow laterally between the plurality of forward extending and spaced structures before impacting the projectile, and the rear section engaging a biasing spring for biasing the valve element to the forward position; and a pivotal trigger and arm mounted to the housing for maintaining the piston and the drive spring in a cocked position after the drive spring is compressed by manually pulling on the cocking hand and, after inserting the projectile into the front opening of the barrel section to move the valve element from the forward position to the rearward position, for releasing the piston and drive spring to cause discharge of the projectile.

16. The improved safety valve of claim 15, wherein the front valve seat in the valve chamber is for engaging the separating wall of the valve element.

17. The improved safety valve of claim 16, comprising a spike connected to the housing in a fixed position, the spike extending through the valve chamber and into the barrel section and through an opening in the separating wall.

18. The improved safety valve of claim 15, wherein the front section for engaging the projectile includes a plurality of posts.

19. The improved safety valve of claim 15, wherein:

the separating wall of the valve element engages the valve seat along a peripheral portion of the separating wall.

* * * * *